US008628160B2

(12) United States Patent
Takano et al.

(10) Patent No.: US 8,628,160 B2
(45) Date of Patent: Jan. 14, 2014

(54) INK JET RECORDING APPARATUS

(75) Inventors: Hiroyoshi Takano, Nagano (JP); Yukihiro Uchiyama, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 78 days.

(21) Appl. No.: 13/535,375

(22) Filed: Jun. 28, 2012

(65) Prior Publication Data

US 2013/0002748 A1 Jan. 3, 2013

(30) Foreign Application Priority Data

Jun. 30, 2011 (JP) ..... 2011-145545

(51) Int. Cl.
*B41J 2/175* (2006.01)

(52) U.S. Cl.
USPC ..... 347/14; 347/84

(58) Field of Classification Search
USPC ..... 347/5, 7, 14, 84, 85
See application file for complete search history.

(56) References Cited

U.S. PATENT DOCUMENTS 7,380,900 B2 * 6/2008 Kanda et al. ..... 347/19
7,465,043 B2 * 12/2008 Sueoka ..... 347/85
7,874,656 B2 * 1/2011 Ota et al. ..... 347/85

FOREIGN PATENT DOCUMENTS

JP 07-137247 5/1995

* cited by examiner

*Primary Examiner* — Lamson Nguyen
(74) *Attorney, Agent, or Firm* — Jianq Chyun IP Office

(57) ABSTRACT

A control method is provided for an ink jet recording apparatus 30 including a recording head 32 for ejecting ink to a medium 31, a heating means 46 for heating the recording head 32, an ink storage part 12 which reserves ink supplied to the recording head 32, and a negative pressure adjusting part 40 which adjusts a pressure in an inside of the ink storage part 12 to be a negative pressure. In the control method, when the ink jet recording apparatus 30 is to be turned off, heating of the recording head 32 by the heating part 46 is turned off but the negative pressure adjusting part 40 is left to be in an "ON" state so that the negative pressure in the inside of the ink storage part 12 is maintained and, after that, the negative pressure adjusting part 40 is turned off.

10 Claims, 8 Drawing Sheets

INK JET RECORDING APPARATUS

CROSS-REFERENCE TO RELATED APPLICATIONS

This application claims the priority benefit of Japan application serial no. 2011-145545, filed on Jun. 30, 2011. The entirety of the above-mentioned patent application is hereby incorporated by reference herein and made a part of this specification.

TECHNICAL FIELD

The present invention relates to an ink jet recording apparatus which is capable of controlling a pressure in the inside of a sub-tank from which ink is supplied to a recording head.

BACKGROUND ART

In an ink jet recording apparatus in which ink is ejected to a medium from a recording head, a plurality of minute opening parts is formed in the recording head and ink is ejected from the opening part.

In this case, when a pressure in the inside of the recording head becomes the same pressure or higher than the atmospheric pressure, the ink leaks out little by little from the opening part of the recording head by a feeding pressure of the ink to the recording head.

Therefore, in order to set the inside of the recording head under a weak negative pressure, a structure has been conventionally known in which a sub-tank with a small volume for ink is provided and, while the inside of the sub-tank is adjusted to a weak negative pressure, the ink is supplied to the recording head from the sub-tank and thereby leakage of the ink from the recording head is prevented.

Further, as shown in Patent Literature 1, regarding the ejection of ink from the recording head, in order to stabilize an ejected quantity of ink for maintaining a recording density to be uniform, a structure has been known in which a recording temperature is set to be higher than a predetermined temperature.

In Patent Literature 1, a structure is disclosed which is provided with a heater for heating a recording head to maintain the recording head in a first temperature range and a timer which counts an elapsed time period from the time when the ejection from the recording head is finished and, when the timer counts a predetermined time period, the recording head is maintained in a second temperature range lower than the first temperature range.

CITATION LIST

Patent Literature

[PTL 1] Japanese Patent Laid-Open No. H7-137247

SUMMARY OF INVENTION

Technical Problem

According to the conventional ink jet recording apparatus described above, since the recording head is always heated, even when high viscosity ink such as "UV" ink is used, the viscosity of the ink is reduced to eject satisfactorily.

Further, after a predetermined time period has elapsed from the time when the ejection of the ink is finished, the temperature of the recording head is lowered so that evaporation of the water content of the ink may be suppressed and thereby defective ejection of the ink due to nozzle clogging or the like can be prevented.

However, in the conventional ink jet recording apparatus described above, even when the temperature of the recording head is lowered after a predetermined time period has passed from the time when the ink ejection is finished, defective ejection of the ink may occur. Therefore, the present inventors have deeply continued investigation and reached its solution.

In view of the problem described above, an objective of the present invention is to provide a control method for an ink jet recording apparatus which is capable of preventing the defective ejection of ink in a case that a recording head is heated.

Solution to Problem

In order to attain the above-mentioned objective, the present invention provides a control method for an ink jet recording apparatus having a recording head for ejecting ink to a medium, a heating part for heating the recording head, an ink storage part which reserves ink supplied to the recording head, and a negative pressure adjusting part which adjusts a pressure in the inside of the ink storage part to be a negative pressure. In the control method, when the ink jet recording apparatus is to be turned off, heating of the recording head by the heating part is turned off but the negative pressure adjusting part is left to be in an "ON" state so that the negative pressure in the inside of the ink storage part is maintained and, after that, the negative pressure adjusting part is turned off.

The operation in this method is as follows.

In other words, the present inventors have found that, in a case that the heating of the recording head and the negative pressure adjustment of the ink storage part are simultaneously turned off, the nozzle's irregular ejection occurs in the printing at the time of being activated next time and the present inventors have investigated the cause thoroughly. As a result, the present inventors have found that, although it is known that the temperature of the ink in the ink storage part is high by heating the recording head, when the heating of the recording head and the negative pressure adjustment of the ink storage part are simultaneously turned off, the temperature of the ink in the inside of the ink storage part is lowered and then the volume of the air in the inside of the ink storage part is contracted and thus the negative pressure in the inside of the ink storage part (pressure of air portion other than the ink) becomes large. Further, the present inventors have conceived that, when the negative pressure in the inside of the ink storage part becomes large, since air is flowed from an opening part which is an ink ejecting portion of the recording head into the inside of the ink storage part, in other words, since the inside of the ink storage part and the outside are communicated with each other, when activated next time, the ink is hard to be introduced into a portion again where the ink storage part and the outside have been communicated with each other to cause the nozzle's irregular ejection to occur.

Therefore, by adopting the above-mentioned control method, the negative pressure adjustment is executed after the heating part is turned off and during the temperature is lowered and, as a result, the negative pressure does not reach a head limit negative pressure region in which the inside of the ink storage part and the outside are communicated with each other based on the lowering of the temperature of the recording head.

The above-mentioned point will be described below with reference to FIGS. 7 and 8.

FIG. 7 is a graph showing change of a negative pressure in a conventional sub-tank (corresponding to the ink storage part in CLAIM, the same applies to the following) and change of temperature of a side face of the sub-tank.

As shown in this FIG. 7, first, when the power source is turned off, the temperature of the side face of the sub-tank which is about 34° C. is lowered in an inverse proportion manner with respect to an elapsed time after the power source is turned off. Accompanied with this temperature change, the negative pressure in the inside of the sub-tank increases in an inverse proportion manner. However, the present inventors have found that the negative pressure in the inside of the sub-tank is increased to about −5 kPa after the lapse of about 1.4 hour from the time when the power source is turned off and then is decreased to about −2.6 kPa in about 50 seconds. The present inventors have deeply continued investigation and then confirmed that this phenomenon is the result of the situation in which the inside of the sub-tank and the outside have been communicated with each other. Further, the present inventors have found that the negative pressure in the inside of the sub-tank which is larger than about −4.1 kPa is set to be a head limit negative pressure region and, when the negative pressure adjustment is executed so as not to reach the head limit negative pressure region, the inside of the sub-tank and the outside are not communicated with each other.

On the other hand, FIG. 8 is a graph showing change of a negative pressure in a sub-tank (corresponding to the ink storage part in CLAIM, the same applies to the following) and temperature change of a side face of the sub-tank in accordance with the present invention.

According to this graph, first, after about two hours from the time when only the heating of the recording head is turned off, the temperature of the side face of the sub-tank is lowered by about 10° C. During this time, the negative pressure adjusting part is left to be in an "ON" state and thus the negative pressure in the inside of the sub-tank is maintained to be the initial value of −2.3 kPa.

And then, the negative pressure adjusting part is turned off after about two hours from the time when the heating of the recording head is turned off. In this case, although the negative pressure in the inside of the sub-tank is increased in an inverse proportion manner but, different from the case in FIG. 7, the temperature of the sub-tank has been lowered in advance and thus the negative pressure is not rapidly increased and the negative pressure becomes constant (about −3.5 kPa) after about 6.6 hours from the time when the negative pressure adjusting part is turned off. In this manner, in the case shown in FIG. 8, the negative pressure in the inside of the sub-tank becomes constant to be about −3.5 kPa and does not reach the head limit negative pressure region. The margin until the negative pressure in the inside of the sub-tank reaches the head limit negative pressure region is about 0.6 kPa. As described above, the negative pressure adjusting part is turned off after the lapse of a predetermined time period from the time when the heating part is turned off and thereby the negative pressure in the inside of the sub-tank is prevented from reaching the head limit negative pressure region and thus the inside of the sub-tank and the outside are not communicated with each other.

In order to attain the above-mentioned objective, the present invention provides a control method for an ink jet recording apparatus having a recording head for ejecting ink to a medium, a heating part for heating the recording head, an ink storage part which reserves ink supplied to the recording head, and a negative pressure adjusting part which adjusts a pressure in an inside of the ink storage part to be a negative pressure. In the control method, when the ink jet recording apparatus is to be turned off, heating of the recording head by the heating part is turned off and the negative pressure adjusting part is controlled as a sleep mode in which the negative pressure adjusting part is repeatedly activated at a predetermined period.

The operation in this method is as follows.

As described above, the present inventors have found that, when the heating of the recording head and the negative pressure adjustment in the ink storage part are simultaneously turned off, the nozzle's irregular ejection is occurred in printing when activated next time. In order to prevent this problem, it is sufficient that, after heating by the heating part is finished, the negative pressure in the inside of the ink storage part is adjusted so as not to become too large, in other words, the negative pressure in the inside of the ink storage part is adjusted so as not to reach the head limit negative pressure region in which the inside of the ink storage part and the outside are communicated with each other. Therefore, the negative pressure control section is repeatedly activated at a predetermined period to adjust the negative pressure and thereby the negative pressure in the inside of the ink storage part is adjusted so as not to reach the head limit negative pressure region in which the inside of the ink storage part and the outside are communicated with each other based on the lowering of the temperature of the recording head.

In order to attain the above-mentioned objective, the present invention provides a control method for an ink jet recording apparatus having a recording head for ejecting ink to a medium, a heating part for heating the recording head, an ink storage part which reserves ink supplied to the recording head, and a negative pressure adjusting part which adjusts a pressure in an inside of the ink storage part to be a negative pressure. In the control method, when the ink jet recording apparatus is not operated for a predetermined time period, the heating part is automatically turned off and the negative pressure adjusting part is left to be in an "ON" state so that the negative pressure in the inside of the ink storage part is maintained and, after that, the negative pressure adjusting part is turned off.

According to this method, when the ink jet recording apparatus is not operated for a certain time, the heating part may be turned off and thus a time period until the entire apparatus is turned off can be shortened. Further, the negative pressure adjustment is executed during a time when the heating part is turned off to lower the temperature and thereby the negative pressure in the inside of the ink storage part is adjusted so as not to reach the head limit negative pressure region in which the inside of the ink storage part and the outside are communicated with each other based on the lowering of the temperature of the recording head.

Further, in the control method for the ink jet recording apparatus in accordance with the present invention, it is preferable that the negative pressure adjusting part executes negative pressure adjustment so as not to reach a head limit negative pressure region in which air in the inside of the ink storage part and a plurality of opening parts of the recording head from which the ink is ejected are communicated with each other.

According to this method, unless the negative pressure in the inside of the ink storage part does not reach the head limit negative pressure, the air in the inside of the ink storage part and the opening part of the recording head are not communicated with each other and thus the nozzle's irregular ejection when activated next time can be prevented.

Further, in the control method for the ink jet recording apparatus in accordance with the present invention, it is preferable that, when the heating part is turned off, the negative pressure adjusting part reduces the negative pressure in the inside of the ink storage part to an extent that dropping of the ink does not occur.

According to this method, in order to attain the objective of the present invention in which the negative pressure in the inside of the ink storage part is prevented from becoming too large as the temperature is lowered, since the negative pressure is reduced to an extent that dropping of the ink does not occur and thus, even when the negative pressure becomes large, the negative pressure is prevented from becoming a large value so that the air in the inside of the ink storage part and an opening part of the recording head are communicated with each other.

ADVANTAGEOUS EFFECTS OF INVENTION

According to the present invention, defective ejection of ink caused by a further large negative pressure in the inside of the ink storage part is prevented.

DESCRIPTION OF EMBODIMENTS

First Embodiment

Preferred embodiments of the present invention will be described below with reference to the accompanying drawings.

Figure 1:
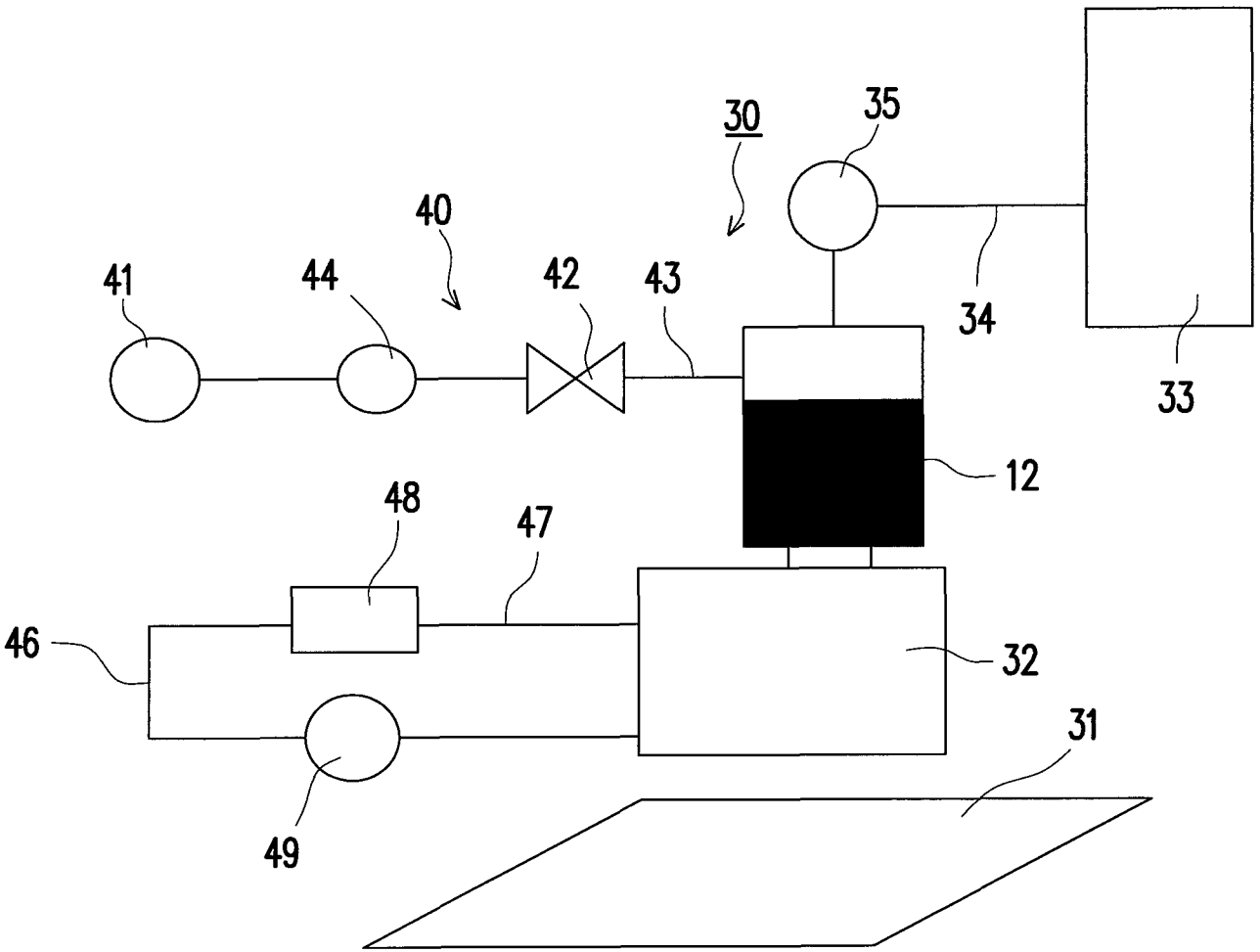
FIG. 1 is a schematic structure view showing an ink jet recording apparatus.

FIG. 1 is a schematic view showing ink supply to a recording head in an ink jet recording apparatus.

An ink jet recording apparatus 30 is an apparatus which is structured to perform printing on a medium 31 by ink jets. The ink jet recording apparatus 30 includes a recording head 32 for ejecting ink to a medium 31 and a sub-tank 12 (ink storage part in CLAIM) which reserves ink to be supplied to the recording head 32.

An ink cartridge 33 is connected with the sub-tank 12 through an ink supply pipe 34. A pressure-feed pump 35 is provided in a midway part of the ink supply pipe 34 and ink in the ink cartridge 33 is supplied to the sub-tank 12 by driving the pressure-feed pump 35.

A negative pressure adjusting part 40 is provided in the sub-tank 12. The negative pressure adjusting part 40 includes an air flow passage 43 which is connected with an air reservoir portion located at an upper part of the sub-tank 12, a pressure adjusting pump 41 which is connected with the air flow passage 43, a pressure sensor 44 which detects a pressure in the inside of the air flow passage 41, and a control valve 42.

The negative pressure adjusting part 40 adjusts a pressure in the air reservoir portion on an upper side with respect to the ink in the inside of the sub-tank 12 to be a weak negative pressure and thereby dropping (described below) of the ink from an ejection port of a nozzle hole of the recording head 32 is avoided.

In a case that the air reservoir portion in the inside of the sub-tank 12 is not adjusted under a weak negative pressure by the negative pressure adjusting part 40 as described above, for example, when the pressure in the inside of the sub-tank 12 becomes not less than an atmospheric pressure, the ink is pushed out from the recording head 32 to cause so-called "dropping" to occur. Therefore, the air reservoir portion in the inside of the sub-tank 12 is adjusted so as to be a negative pressure (−2.5 kPa through −2.3 kPa) which is slightly lower than the atmospheric pressure by the negative pressure adjusting part 40.

The recording head 32 is provided with a heating part 46. The heating part 46 is provided so that warm water circulates through a warm water circulation pipe 47 and the warm water is flowed so as to surround the recording head 32. The heating part 46 includes a heater 48 for heating water and a circulating pump 49 for circulating warm water heated by the heater 48.

In this embodiment, the recording head 32 is heated to approximately 48° C. by the heating part 46. When the recording head 32 is heated to the temperature of such a degree, even when ink having high viscosity such as UV ink is ejected, the viscosity of the ink is lowered and ejection of the ink can be performed satisfactorily.

Figure 2:
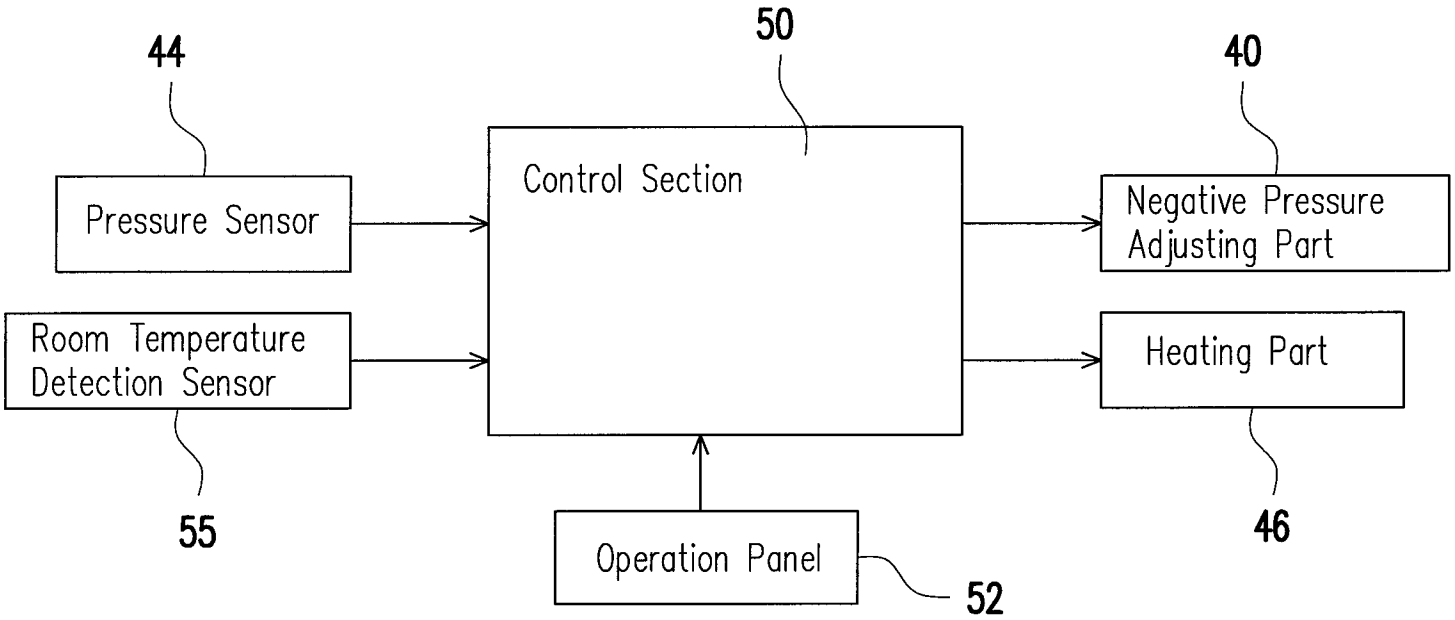
FIG. 2 is a control block diagram showing a first embodiment of the present invention.

Next, a block diagram of a control mechanism relating to the negative pressure adjustment of the ink jet recording apparatus and heating of the recording head is shown in FIG. 2.

Control of the negative pressure adjusting part 40 and the heating part 46 for the recording head 32 is executed by the control section 50. The control section 50 includes a microprocessor such as a CPU and memories comprised of a ROM and a RAM and is capable of executing predetermined operations based on control programs stored in the memories.

An operation panel 52 is connected with the control section 50. A user is capable of controlling the operation of the ink jet recording apparatus by operating the operation panel 52.

Pressure data detected by the pressure sensor 44 are inputted into the control section 50 and the pressure adjusting pump 41 and the control valve 42 are controlled based on the pressure in the inside of the sub-tank 12 which is detected by the pressure sensor 44 to maintain the pressure in the inside of the sub-tank 12 at a predetermined negative pressure.

Further, the heating part 46 is connected with the control section 50 and "ON"-"OFF" of the heater 48 of the heating part 46 and "ON"-"OFF" of the circulating pump 49 can be controlled by a control signal from the control section 50.

Figure 3:
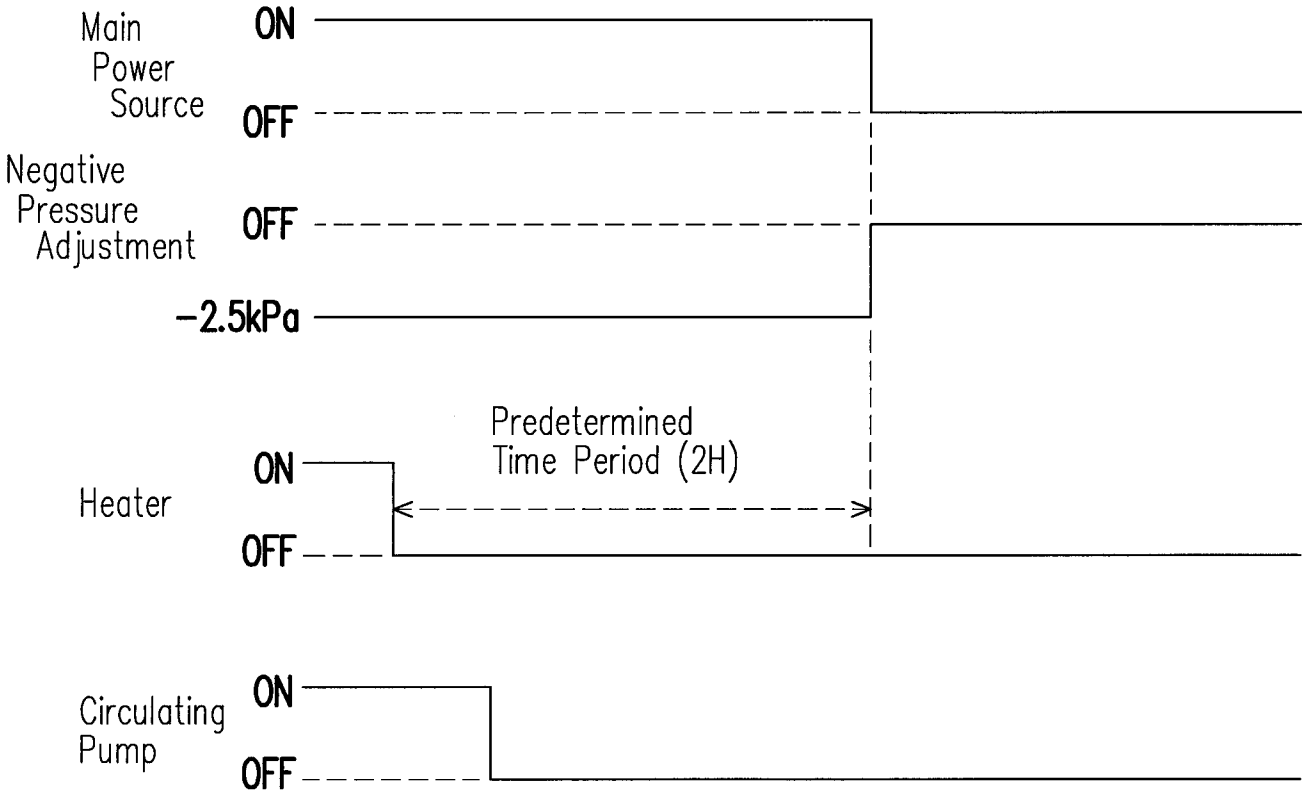
FIG. 3 is a time chart showing a control method in the first embodiment of the present invention.

A control method in this embodiment of the present invention is shown in FIG. 3.

When the ink jet recording apparatus 30 is to be turned off, a user operates the operation panel 52 to turn off the ink jet recording apparatus 30. The operation panel 52 is provided with an "OFF" switch and, when the "OFF" switch is operated, the control section 50 executes an operation on the basis of a control program previously stored in the memory.

When the "OFF" switch is pressed down, first, the control section 50 turns off the heating part 46. Specifically, first, only the heater 48 is turned off and the circulating pump 49 is left to be in an "ON" state. As a result, gradually cooling water is circulated through the heating part 46 to gradually lower the temperature of the recording head 32.

Next, the control section 50 turns off the circulating pump 49 after the lapse of a predetermined time period after the heater 48 is turned off. As a result, the operation of the heating part 50 is completely turned off.

In this embodiment, although the heating part 46 is turned off, the control section 50 continues to operate the negative pressure adjusting part 40 as it is without turning off.

The control section 50 turns off the negative pressure adjusting part 40 after an elapse of the predetermined time period from the time when the heater 48 of the heating part 46 is turned off. Therefore, even when the temperature in the sub-tank 12 is lowered by turning off the heating part 46 and the volume of the ink in the sub-tank 12 is decreased, a pressure in the air reservoir portion in the inside of the sub-tank 12 is maintained to be a fixed pressure without becoming a large negative pressure. In this case, as a result of experimental measurement, it takes about two hours to make the temperature in the inside of the sub-tank 12 to be substantially constant, it is preferable that the predetermined time period is about two hours.

The negative pressure adjusting part 40 executes negative pressure adjustment so as not to reach a head limit negative pressure region in which air in the sub-tank 12 and the opening part of the recording head 32 are communicated with each other. Therefore, the inside of the sub-tank 12 and the outside air are prevented from being communicated with each other through the recording head 32 and thus the nozzle's irregular ejection when activated next time can be prevented.

When the negative pressure adjusting part 40 is turned off, the entire operation of the ink jet recording apparatus 30 is turned off.

Further, when the ink jet recording apparatus 30 is turned off, since the inside of the sub-tank 12 is set to be under a negative pressure so as not to reach the head limit negative pressure region in which the ink storage part in the sub-tank 12 and the outside are communicated with each other, even when the power source is turned on next time, the ink storage part in the sub-tank 12 is not communicated with the outside and thus the nozzle's irregular ejection does not occur and satisfactory ink ejection can be attained.

Further, in this embodiment, a time period from the time when the heating part 46 is turned off until the time when the negative pressure adjusting part 40 is turned off may be increased or decreased depending on the ambient temperature.

In other words, a room temperature detection sensor 55 is provided in the ink jet recording apparatus 30 and, when the room temperature detected by the room temperature detection sensor 55 is low, the control section 50 controls the time period from the time when the heater 48 of the heating part 46 is turned off until the time when the negative pressure adjusting part 40 is turned off to be shortened with lowering of the room temperature. According to this structure, a time period until the entire power source is turned off can be shortened.

Second Embodiment

Next, a second embodiment of the present invention will be described below.

A structure relating to the ink supply to the recording head in an ink jet recording apparatus is the same as the first embodiment which is described with reference to FIG. 1 and thus its description is omitted.

Figure 4:
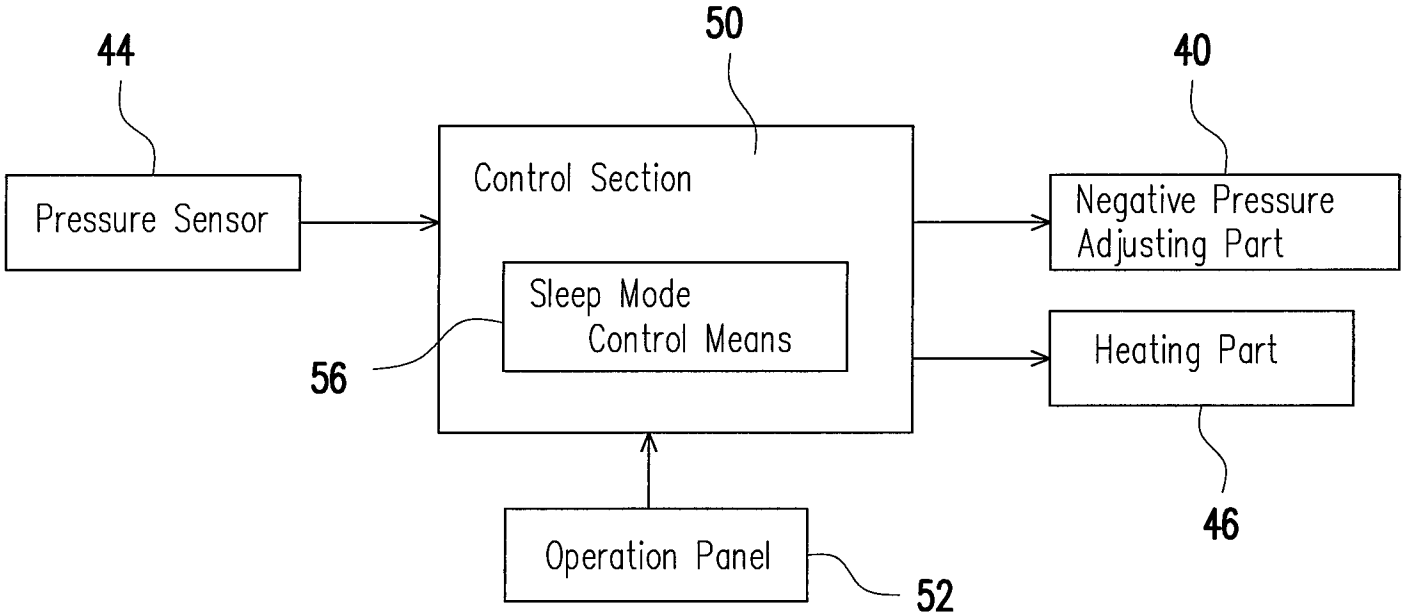
FIG. 4 is a control block diagram showing a second embodiment of the present invention.

FIG. 4 is a block diagram showing a control mechanism relating to negative pressure adjustment and heating of a recording head in an ink jet recording apparatus in accordance with the second embodiment of the present invention. The same reference signs are used for the same structural elements as the structure shown in FIG. 2 and their descriptions are omitted.

In this embodiment, the control section 50 is provided with a sleep mode control means 56 which is capable of executing a sleep mode. The sleep mode control means 56 in this embodiment is a control program which is programmed so that, when an "OFF" operation of the power source is performed through an operation panel 52, the heating part 46 and the negative pressure adjusting part 40 are simultaneously turned off and then, the negative pressure adjusting part 40 is activated at a predetermined interval.

Figure 5:
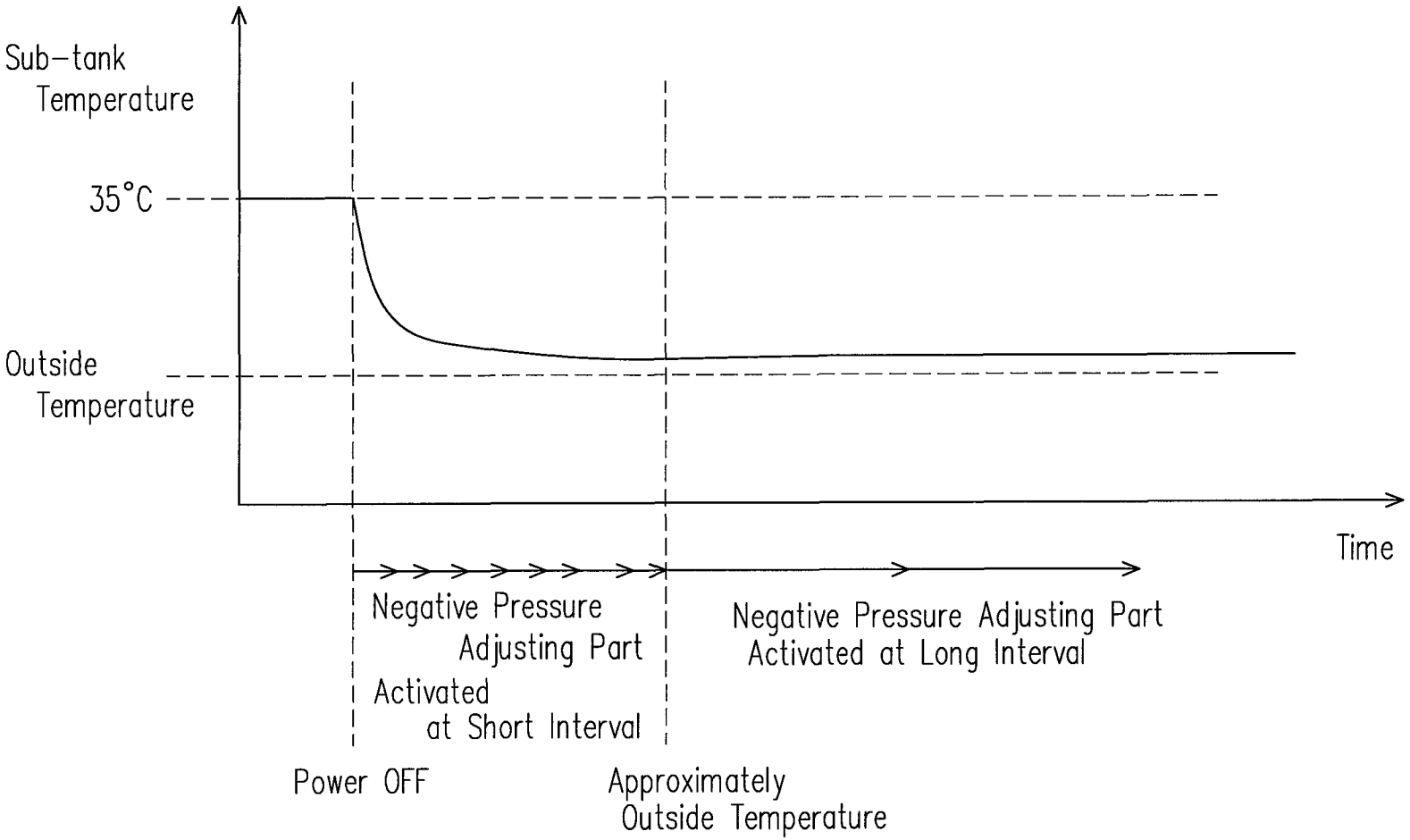
FIG. 5 is a time chart showing a control method in the second embodiment of the present invention.

A control method in accordance with the second embodiment is shown in FIG. 5.

When the ink jet recording apparatus 30 is to be turned off, a user operates the operation panel 52 to turn off the ink jet recording apparatus 30. The operation panel 52 is provided with an "OFF" switch and, when the "OFF" switch is operated, the control section 50 executes an operation on the basis of a control program previously stored in the memory.

When the "OFF" switch is pressed down, first, the control section 50 turns off the heating part 46 and the negative pressure adjusting part 46. In this embodiment, similarly to the first embodiment, it is preferable that an "OFF" operation of the heating part 46 is executed so that, first, only the heater 48 is turned off and the circulating pump 49 is left to be turned on and, after a predetermined time period has elapsed from the time when the heater 48 is turned off, the circulating pump 49 is turned off. According to this structure, gradually cooling water is circulated through the heating part 46 to gradually lower the temperature of the recording head 32.

Next, the sleep mode control means 56 of the control section 50 turns the negative pressure adjusting part 40 "ON" and "OFF" at a predetermined interval after the heater 48 is turned off. For example, the negative pressure adjusting part 40 is activated at the interval of five minutes and the increase of the negative pressure in the inside of the sub-tank 12 caused by volume reduction due to the lowering of the temperature of the ink can be prevented.

Further, after a predetermined time period (experimentally, after the lapse of about two hours, the temperature in the inside of the sub-tank 12 becomes constant and thus about two hours are preferable) has elapsed from the time when the heating part 46 is turned off, the sleep mode control means 56 controls so that an "ON" and "OFF" operation of the negative pressure adjusting part 40 is stopped.

In accordance with an embodiment of the present invention, after the lapse of two hours when the temperature in the inside of the sub-tank 12 becomes constant, the sleep mode control means 56 may execute an "ON" and "OFF" operation of the negative pressure adjusting part 40 at a predetermined interval. In this case, it is sufficient that the sleep mode control means 56 executes an "ON" and "OFF" operation at an interval (for example, about 20 minutes) which is longer than the interval at which the "ON" and "OFF" operation of the negative pressure adjusting part 40 is executed before the temperature in the inside of the sub-tank 12 becomes constant.

The negative pressure adjusting part 40 in which an "ON" and "OFF" operation is performed executes negative pressure adjustment so as not to reach the head limit negative pressure region in which air in the sub-tank 12 and the opening part of the recording head 32 is communicated with each other. Therefore, the inside of the sub-tank 12 and the outside air are prevented from being communicated with each other through the recording head 32 and thus the nozzle's irregular ejection when activated next time can be prevented.

Third Embodiment

Next, a third embodiment of the present invention will be described below.

A structure relating to the ink supply to the recording head in an ink jet recording apparatus is the same as the first embodiment and a control block diagram is the same as the second embodiment and thus their descriptions are omitted.

In the third embodiment, a sleep mode control means 56 is provided which is a control program programmed so that, when the ink jet recording apparatus 30 is not operated for a predetermined time period, a sleep mode is executed automatically.

In this embodiment, when the ink jet recording apparatus 30 is not operated for a predetermined time period (for example, one hour), the sleep mode control means 56 controls to set the sleep mode.

Figure 6:
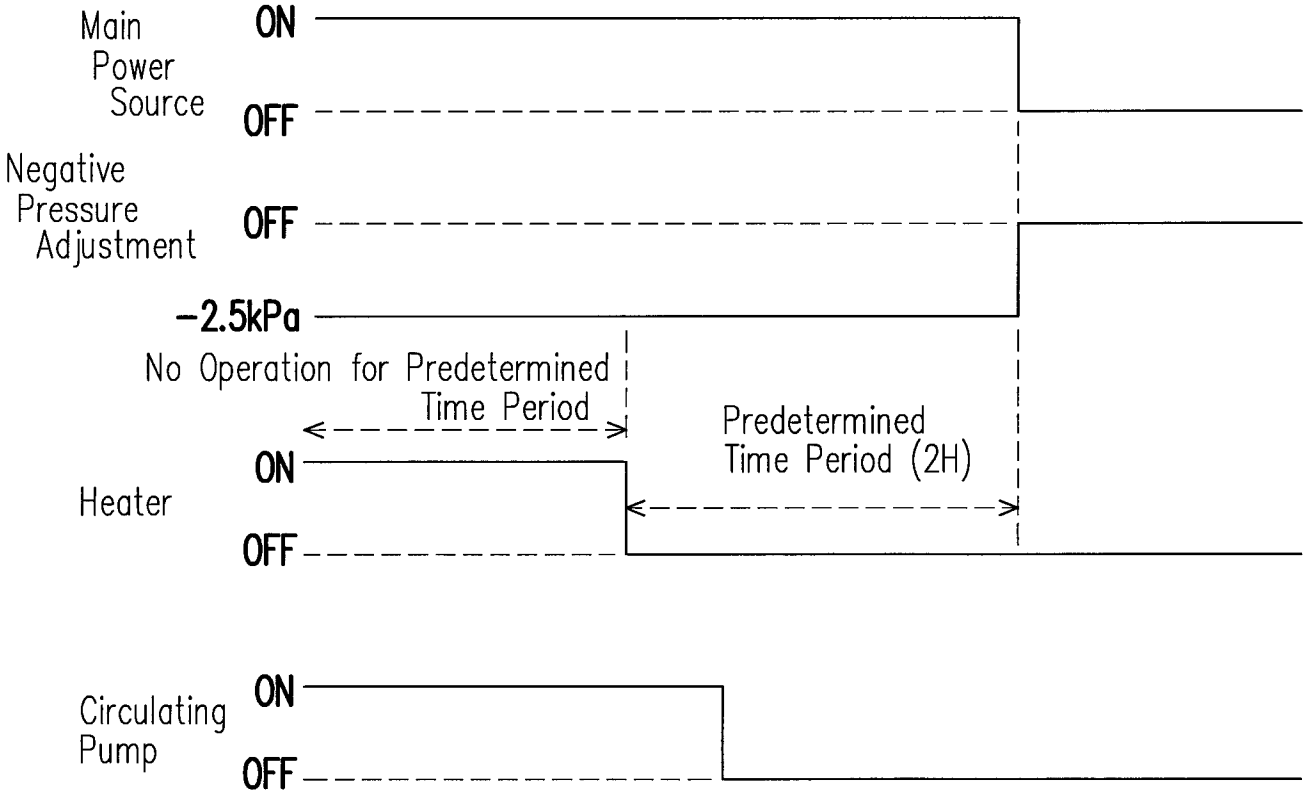
FIG. 6 is a time chart showing a control method in a third embodiment of the present invention.
Figure 7:
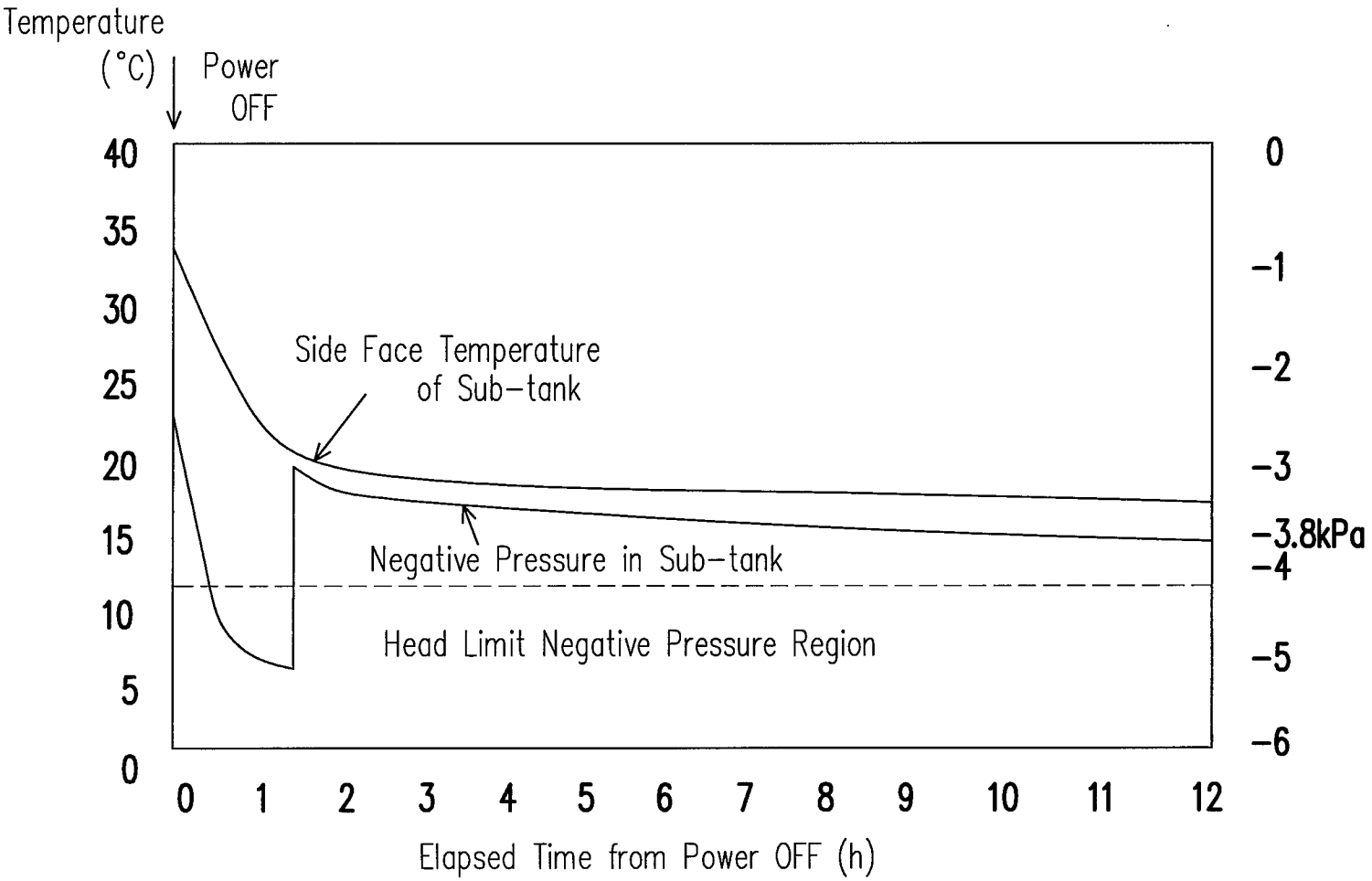
FIG. 7 is a graph showing pressure change in an inside of the conventional sub-tank.
Figure 8:
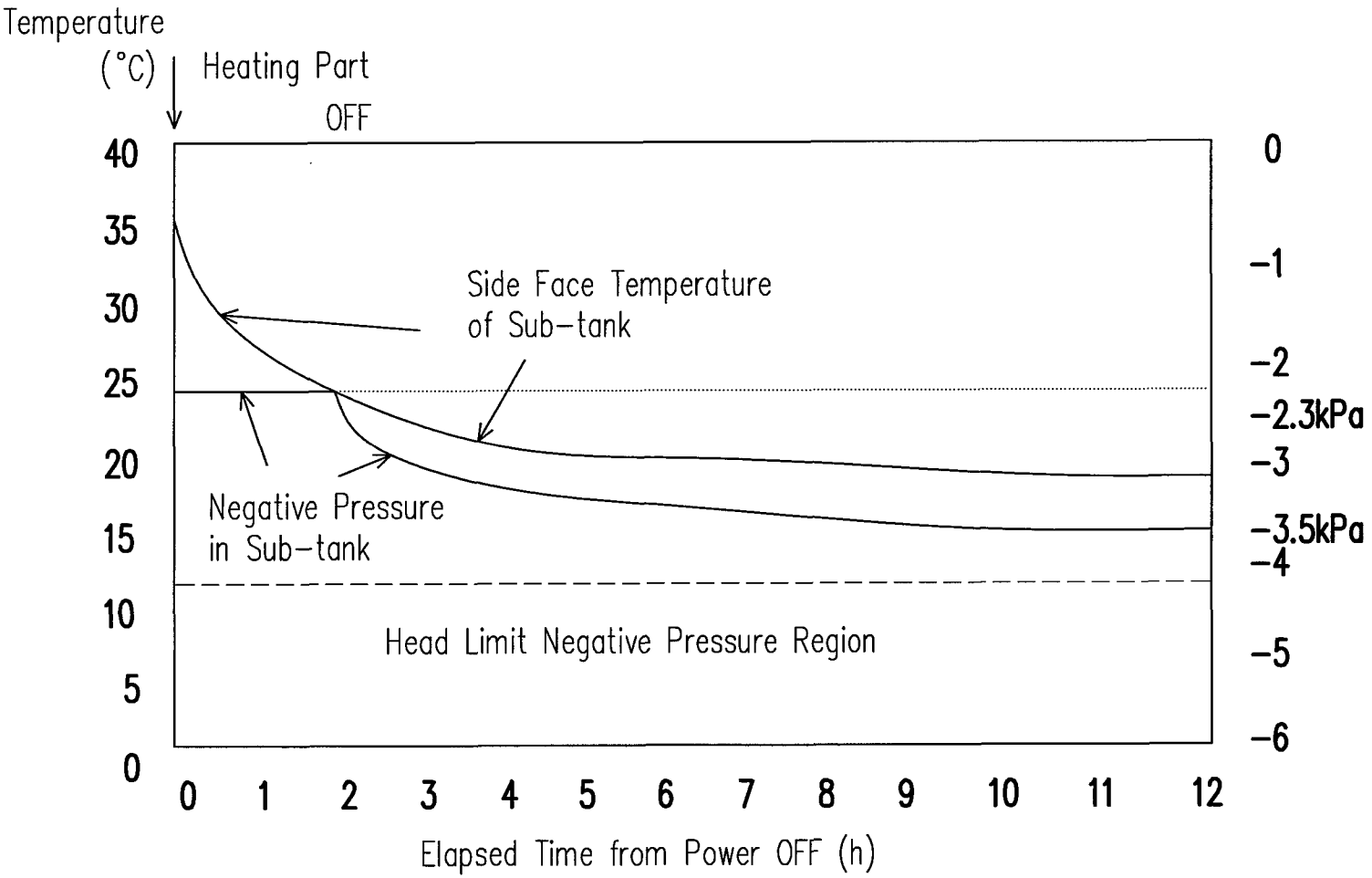
FIG. 8 is a graph showing pressure change in an inside of a sub-tank to which the present invention is applied.

A control method in accordance with the third embodiment is shown in FIG. 6.

When a user does not operate the ink jet recording apparatus 30 for a predetermined time period, first, the sleep mode control means 56 turns off the heating part 46. Specifically, first, only the heater 48 is turned off and the circulating pump 49 is left to be turned on. As a result, gradually cooling water is circulated through the heating part 46 to gradually lower the temperature of the recording head 32.

Next, the sleep mode control means 56 turns off the circulating pump 49 after a predetermined time period has elapsed from the time when the heater 48 is turned off. As a result, the operation of the heating part 50 is completely turned off.

In this embodiment, although the heating part 46 is turned off, the sleep mode control means 56 continues to operate the negative pressure adjusting part 40 as it is without turning off.

The sleep mode control means 56 turns off the negative pressure adjusting part 40 after the lapse of a predetermined time period from the time when the heater 48 of the heating part 46 is turned off. Therefore, even when the temperature in the sub-tank 12 is lowered by turning off the heating part 46 and the volume of the ink in the sub-tank 12 is decreased, a pressure in the air reservoir portion in the inside of the sub-tank 12 is set to be a negative pressure so as not to reach the head limit negative pressure region in which the inside of the ink storage part and the outside are communicated with each other and the pressure is maintained to be a fixed pressure. In this case, as a result of experimental measurement, it takes about two hours to make the temperature in the inside of the sub-tank 12 to be substantially constant and thus it is preferable that the predetermined time period is about two hours.

When the negative pressure adjusting part 40 is turned off, the entire operation of the ink jet recording apparatus 30 is turned off.

Further, when the ink jet recording apparatus 30 is turned off, since the inside of the sub-tank 12 is set to be under a negative pressure so as not to reach the head limit negative pressure region in which the ink storage part in the sub-tank 12 and the outside are communicated with each other, even when the power source is turned on next time, the ink storage part in the sub-tank 12 is not communicated with the outside and thus the nozzle's irregular ejection does not occur and satisfactory ink ejection can be attained.

The negative pressure adjusting part 40 executes negative pressure adjustment so as not to reach the head limit negative pressure region in which air in the sub-tank 12 and the opening part of the recording head 32 are communicated with each other. Therefore, the inside of the sub-tank 12 and the outside air are prevented from being communicated with each other through the recording head 32 and thus the nozzle's irregular ejection when activated next time can be prevented.

In each of the above-mentioned embodiments, it is preferable that, when the heating part 46 is turned off, the negative pressure adjusting part 40 reduces the negative pressure in the inside of the sub-tank 12 to the extent that dropping of the ink does not occur. For example, although the negative pressure at a normal time is −2.5 kPa through −2.3 kPa, the negative pressure may be reduced (pressure is increased) to about −1.01 cPa. Even when the negative pressure in the inside of the sub-tank 12 becomes larger as the temperature is lowered, the negative pressure does not reach the head limit negative pressure region as much as possible because the negative pressure is reduced in advance.

The invention claimed is:

1. A control method for an ink jet recording apparatus including a recording head configured to eject ink to a medium, a heating part configured to heat the recording head, an ink storage part configured to reserve ink which is supplied to the recording head, and a negative pressure adjusting part configured to adjust a pressure in an inside of the ink storage part to be a negative pressure, the control method comprising:

when the ink jet recording apparatus is to be turned off, heating of the recording head by the heating part is turned off but the negative pressure adjusting part is left to be in an "ON" state so that the negative pressure in the inside of the ink storage part is maintained, after that, the negative pressure adjusting part is turned off.

2. The control method for an ink jet recording apparatus according to claim 1, wherein the negative pressure adjusting part executes negative pressure adjustment so as not to reach a head limit negative pressure region in which air in the inside of the ink storage part and a plurality of opening parts of the recording head from which the ink is ejected are communicated with each other.

3. The control method for an ink jet recording apparatus according to claim 2, wherein when the heating part is turned off, the negative pressure adjusting part reduces the negative pressure in the inside of the ink storage part to an extent that dropping of the ink does not occur.

4. The control method for an ink jet recording apparatus according to claim 1, wherein when the heating part is turned off, the negative pressure adjusting part reduces the negative pressure in the inside of the ink storage part to an extent that dropping of the ink does not occur.

5. A control method for an ink jet recording apparatus including a recording head configured to eject ink to a medium, a heating part configured to heat the recording head, an ink storage part configured to reserve ink which is supplied to the recording head, and a negative pressure adjusting part configured to adjust a pressure in an inside of the ink storage part to be a negative pressure, the control method comprising:

when the ink jet recording apparatus is to be turned off, heating of the recording head by the heating part is turned off, and the negative pressure adjusting part is controlled as a sleep mode in which the negative pressure adjusting part is repeatedly activated at a predetermined period.

6. The control method for an ink jet recording apparatus according to claim 5, wherein the negative pressure adjusting part executes negative pressure adjustment so as not to reach a head limit negative pressure region in which air in the inside of the ink storage part and a plurality of opening parts of the recording head from which the ink is ejected are communicated with each other.

7. The control method for an ink jet recording apparatus according to claim 5, wherein when the heating part is turned off, the negative pressure adjusting part reduces the negative pressure in the inside of the ink storage part to an extent that dropping of the ink does not occur.

8. A control method for an ink jet recording apparatus including a recording head configured to eject ink to a medium, a heating part configured to heat the recording head, an ink storage part configured to reserve ink which is supplied to the recording head, and a negative pressure adjusting part configured to adjust a pressure in an inside of the ink storage part to be a negative pressure, the control method comprising:

when the ink jet recording apparatus is not operated for a predetermined time period, turning off the heating part automatically and being left the negative pressure adjusting part to be in an "ON" state so that the negative pressure in the inside of the ink storage part is maintained, and after that, turning off the negative pressure adjusting part.

9. The control method for an ink jet recording apparatus according to claim 8, wherein the negative pressure adjusting part executes negative pressure adjustment so as not to reach a head limit negative pressure region in which air in the inside of the ink storage part and a plurality of opening parts of the recording head from which the ink is ejected are communicated with each other.

10. The control method for an ink jet recording apparatus according to claim 8, wherein when the heating part is turned off, the negative pressure adjusting part reduces the negative pressure in the inside of the ink storage part to an extent that dropping of the ink does not occur.

* * * * *